US010163560B2

(12) United States Patent
Sezai et al.

(10) Patent No.: US 10,163,560 B2
(45) Date of Patent: Dec. 25, 2018

(54) COIL DEVICE

(71) Applicant: TDK CORPORATION, Tokyo (JP)

(72) Inventors: Yuji Sezai, Tokyo (JP); Katsushi Yasuhara, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/698,163

(22) Filed: Sep. 7, 2017

(65) Prior Publication Data

US 2018/0096781 A1 Apr. 5, 2018

(30) Foreign Application Priority Data

Sep. 30, 2016 (JP) ..... 2016-194642

(51) Int. Cl.

| | |
|---|---|
| ***H01F 27/29*** | (2006.01) |
| ***H01F 27/30*** | (2006.01) |
| ***H01F 17/02*** | (2006.01) |
| ***H01F 27/28*** | (2006.01) |
| ***H01F 17/04*** | (2006.01) |

(52) U.S. Cl.

CPC ..... *H01F 27/306* (2013.01); *H01F 17/02* (2013.01); *H01F 17/04* (2013.01); *H01F 27/28* (2013.01); *H01F 27/2823* (2013.01); *H01F 27/29* (2013.01); *H01F 2017/048* (2013.01)

(58) Field of Classification Search

CPC ..... H01F 27/00–27/36
USPC ..... 336/65, 90, 83, 220–229
See application file for complete search history.

(56) References Cited

FOREIGN PATENT DOCUMENTS

JP 3654251 B2 6/2005

*Primary Examiner* — Tuyen Nguyen
(74) *Attorney, Agent, or Firm* — Oliff PLC

(57) ABSTRACT

A coil device, in which an air-core coil of a cylindrical shape is buried in a core including a magnetic powder and a resin, showing, CV value of the below described cross sectional areas, $SA_1$ to $SA_5$, 0.55 or less, when an outer diameter of the air-core coil is "$a_1$", an inner diameter of the same is "$a_2$", and a distance between a surface of the core perpendicular to a direction of winding axis and an end of the air-core coil in the direction of winding axis is "h", is provided. The coil device is superior in DC superimposing characteristic while suppressing the magnetic saturation.

8 Claims, 9 Drawing Sheets

COIL DEVICE

BACKGROUND OF THE INVENTION

1. Field of the Invention

The present invention relates to a coil device having an air-core coil and a core in which the air-core coil is buried. In particular, the coil device is preferably mounted on a power supply circuit.

2. Description of the Related Art

Recently, due to a miniaturization and a high performance of the electronic devices, there is an increasing requirement for a miniaturized coil device having a high performance which can cope with a high frequency and a large current in a power circuit, such as a DC-DC converter, driving the electronic devices.

Conventionally, a coil-sealed magnetic device is known as the coil device which can attain the above requirement. The coil-sealed magnetic device buries a wire wound around air-core coil in a dust core, obtained by mixing a magnetic powder and a resin and pressure molding thereof. See such as Patent Article 1.

In order to obtain the miniaturized coil device having a high performance, it is important to suppress a magnetic saturation during a power drive by obtaining a high inductance and holding said high inductance till a range of a large current. In order to suppress the magnetic saturation, it is required to make a distribution of the magnetic flux density, generated in the core composed of a magnetic body, closer to uniform. Note, as an index showing a magnetic saturation characteristic, DC superposition characteristic or so is exemplified.

Patent Article 1 mentions that, the magnetic saturation can be suppressed by making a predetermined relation between the diameter of the through hole of the coil in the coil device and the distance between the coil and the surface of the exterior part of said coil, and determining the relations of the densifications of the magnetic body in the core. In fact, there was a problem that the suppression of the magnetic saturation was insufficient.

Patent Article 1: JP 3654251

DISCLOSURE OF THE INVENTION

Means for Solving the Problems

The present invention was devised considering the above problems. An object of the invention is to provide a coil device which can suppress the magnetic saturation and is superior in DC superposition characteristic.

The present inventors focused on that the magnetic flux density generated in the core varies according to a place inside the core. This is mainly due to the variance of an area of a place in which the magnetic flux passes, according to the place inside the core. As a result, the distribution of the magnetic flux density inside the core becomes ununiform, the magnetic saturation is likely to generate, and DC superposition characteristic becomes deteriorated.

The present inventors considered that the distribution of the magnetic flux density generated at each parts inside the core becomes uniform, when areas in which the magnetic flux passes through are made closer to uniform. Thus, the present inventors found that by specifying the places in which the magnetic flux passes through and by making the areas of said places to be almost the same, namely, by suppressing the variance of each area of said places, the magnetic saturation hardly generated, which lead to a completion of the invention.

The first embodiment of the invention is

[1] A coil device including:

a core including a magnetic powder and a resin;

an air-core coil of a cylindrical shape;

a lead, led from the air-core coil; and a terminal, in which at least the entire air-core coil is buried inside the core, a CV value of below described cross sectional areas, $SA_1$ to $SA_5$, is 0.55 or less, when an outer diameter of the air-core coil is "$a_1$", an inner diameter of the air-core coil is "$a_2$", and a distance between a surface of the core perpendicular to a direction of winding axis of the air-core coil and an end of the air-core coil in the direction of winding axis of the air-core coil is "h", in the coil device, $SA_1$ is an area, in which an area formed by an outer periphery of the core is subtracted by an area formed by an outer periphery of the air-core coil, on a cross section perpendicular to the direction of winding axis of the air-core coil, at ½ of a length of the core in the direction of winding axis of the air-core coil, $SA_2$ is an area expressed by the following formula, $$SA_2 = \frac{\pi a_1 a_2 h}{(a_1 - a_2)} \ln \frac{a_1}{a_2} \quad \text{[Mathematical 1]}$$

$SA_3$ is an area formed by an inner periphery of the air-core coil, on the cross section perpendicular to the direction of winding axis of the air-core coil, at ½ of the length of the core in the direction of winding axis of the air-core coil, $SA_4$ is a sum of ½ of the area, in which the area formed by the outer periphery of the core is subtracted by the area formed by the outer periphery of the air-core coil, and an area shown by $\pi a_1 h \times ½$, on the cross section perpendicular to the direction of winding axis of the air-core coil, at the end of the air-core coil in the direction of winding axis of the air-core coil, and $SA_5$ is a sum of ½ of the area formed by the inner periphery of the air-core coil, and an area shown by $\pi a_2 h \times ½$, on the cross section perpendicular to the direction of winding axis of the air-core coil, at the end of the air-core coil in the direction of winding axis of the air-core coil.

The second embodiment of the invention is

[2] A coil device comprising:

a core comprising a magnetic powder and a resin;

an air-core coil of a square cylindrical shape;

a lead, led from the air-core coil; and a terminal, in which at least the entire air-core coil is buried inside the core, a CV value of below described cross sectional areas, $SA_1$ to $SA_5$, is 0.55 or less, when a length of one side forming an outer periphery of the air-core coil is "$b_1$", a length of one side forming an inner periphery of the air-core coil is "$b_2$" and a distance between a surface of the core perpendicular to a direction of winding axis of the air-core coil and an end of the air-core coil in the direction of winding axis of the air-core coil is "h", in the coil device, $SA_1$ is an area, in which an area formed by an outer periphery of the core is subtracted by an area formed by an outer periphery of the air-core coil, on a cross section perpendicular to the direction of winding axis of the air-core coil at ½ of a length of the core in the direction of winding axis of the air-core coil, $SA_2$ is an area expressed by the following formula, $$SA_2 = \frac{4b_1 b_2 h}{(b_1 - b_2)} \ln \frac{b_1}{b_2} \quad \text{[Mathematical 2]}$$

$SA_3$ is an area formed by an inner periphery of the air-core coil, on the cross section perpendicular to the direction of winding axis of the air-core coil, at ½ of a length of the core in the direction of winding axis of the air-core coil, $SA_4$ is a sum of ½ of the area, in which the area formed by the outer periphery of the core is subtracted by the area formed by the outer periphery of the air-core coil, and an area shown by $2b_1h$, on the cross section perpendicular to the direction of winding axis of the air-core coil, at the end of the air-core coil in the direction of winding axis of the air-core coil, and $SA_5$ is a sum of ½ of the area formed by the inner periphery of the air-core coil, and an area shown by $2b_2h$, on the cross section perpendicular to the direction of winding axis of the air-core coil, at the end of the air-core coil in the direction of winding axis of the air-core coil.

According to the coil device, in which CV values of the cross sections $SA_1$ to $SA_2$ mentioned above are within the above range, the cross sections perpendicular to the magnetic flux at each part of the core are close to uniform. Thus, the magnetic saturation is suppressed and DC superposition characteristic becomes superior.

[3] The coil device according to [1] or [2], in which the CV value is 0.35 or less.

The above effects are further enhanced by further limiting the CV value.

[4] The coil device according to any one of [1] to [3], in which the below described "R" is 0.52 or more and 0.95 or less.

$$R{:}5\times(SA_2)/(SA_1+SA_2+SA_3+SA_4+SA_5)$$

By setting the R value within the above range, the freedom considering the design can be secured and a good DC superposition characteristic can be realized.

[5] The coil device according to [4], in which said "R" is 0.63 or more and 0.95 or less.

The above effects are further enhanced by further limiting the R value.

Hereinafter, the present invention will be described in detail in the following order, referring to the embodiments shown in figures.

1. Coil device
   1.1 The first embodiment
   1.2 The second embodiment
2. Effects of the Embodiments
3. Modified Example

1. Coil Device

1.1 the First Embodiment

Figure 1A:
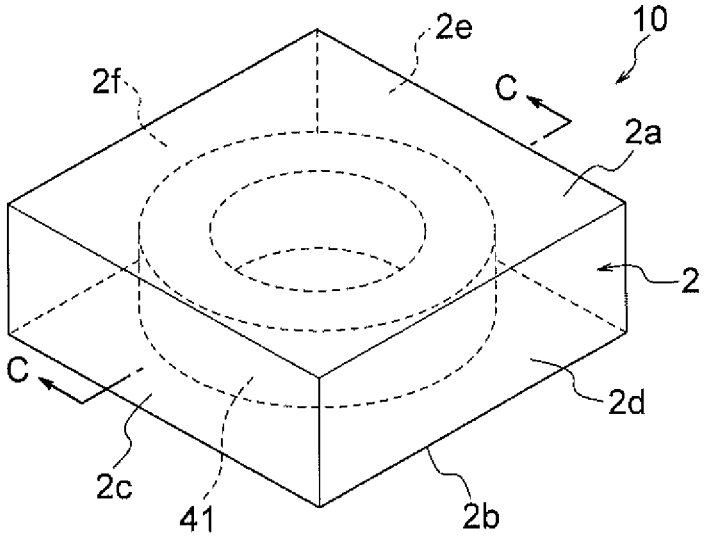
FIG. 1A is a perspective view of the coil device according to the first embodiment of the invention.
Figure 1B:
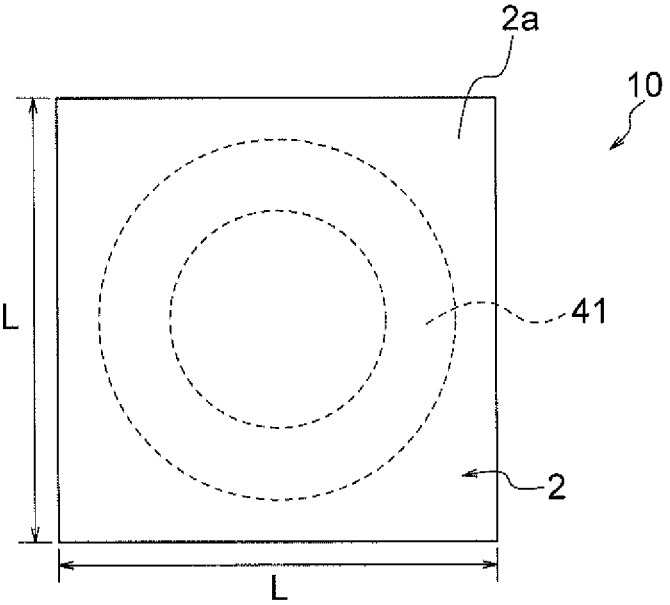
FIG. 1B is a perspective plane view of the coil device according to the first embodiment of the invention.
Figure 1C:
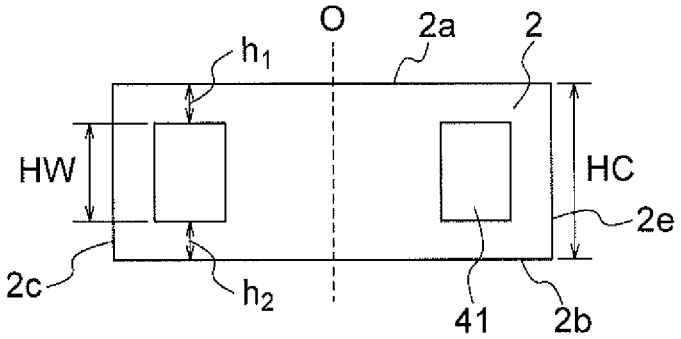
FIG. 1C is a perspective front view of the coil device according to the first embodiment of the invention.

As shown in FIGS. 1A, 1B and 1C, coil device 10 according to the first embodiment includes core 2 of a compression molded body, air-core coil 41 formed by winding around a wire, a not shown lead part, led from air-core coil 41, a not shown terminal part, electrically connected to the lead part and mounted on an outer circumference of core 2. The entire air-core coil 41 is buried inside core 2. Thus, air-core coil 41 cannot be observed from outside in actual coil device 10.

As shown in FIGS. 1A, 1B and 1C, outer shape of core 2 is a square cylindrical shape, in which a square shaped first principal surface 2*a* and a square shaped second principal surface 2*b* are connected via rectangular shaped four outer circumferential surfaces: the first outer circumferential surface 2*c*, the second outer circumferential surface 2*d*, the third outer circumferential surface 2*e* and the forth outer circumferential surface 2*f*. The length of one side of the first principal surface 2*a* and the same of the second principal surface 2*b* are "L". A distance between the first principal surface 2*a* and the second principal surface 2*b*, namely, the height of core 2 is "HC".

Core 2 is the magnetic body exhibiting a magnetic characteristic, and is formed by a compression molding or an injection molding a granule, including a magnetic powder and a resin of a binder binding magnetic particles included in the magnetic powder, and then heat treating thereof when necessary. Materials of the magnetic powder is not limited, as long as it exhibits a predetermined magnetic characteristic, and Fe—Si (iron-silicon), Sendust (Fe—Si—Al; iron-silicon-aluminium), Fe—Si—Cr (iron-silicon-chrome), Permalloy (Fe—Ni), an ironic based, such as a carbonyl iron based, metal magnetic body are exemplified. In addition, ferrites can be such as a Mn—Zn based ferrite, a Ni—Cu—Zn based ferrite, etc.

The resin as the binder is not particularly limited, and an epoxy resin, a phenol resin, an acryl resin, a polyester resin, a polyimide, a polyamide imide, a silicon resin, a combination thereof, etc, are exemplified.

A wire constituting the air-core coil and the lead is, for instance, composed of a lead and an insulating coating layer coating the outer circumference of the lead, when necessary. The lead is composed of, for instance, Cu, Al, Fe, Ag, Au, phosphor bronze, etc. The insulating coating layer is composed of, for instance, polyurethane, polyamide imide, polyimide, polyester, polyester-imide, polyester-nylon, etc. A cross-sectional shape of the winding is not particularly limited, and exemplifies a round shape, a straight angle shape, etc.

Figure 2:
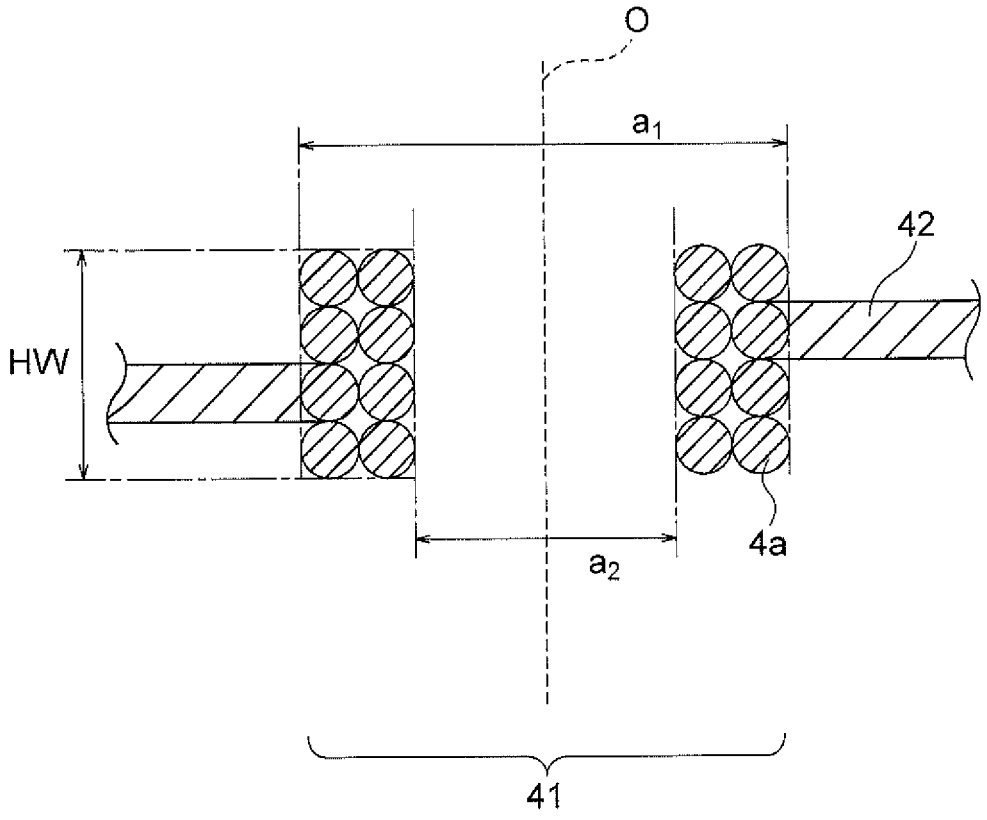
FIG. 2 is a sectional view of an air-core coil part and a lead part.

As shown in FIG. 2, air-core coil 41 is formed by winding wire 4*a*, and lead 42 is led by air-core coil 41. In the present embodiment, air-core coil 41 is a part where wire 4*a* wound around a hollow cylindrical foam. Outer periphery of the cylindrical foam is a round shape having a diameter "$a_1$" and inner periphery of the cylindrical foam is a round shape having a diameter "$a_2$". The height of the cylindrical foam is HW. Said air-core coil 41 is buried inside core 2, making a winding shaft O to be vertical to the both principal surfaces 2*a* and 2*b* of core 2.

Generally, according to the air-core coil buried coil device, in order to make the best use of the generated magnetic flux, the winding shaft passes through the center of the core, and the middle point of the air-core coil in a height direction is disposed so as to be agreed with the same of the core in a height direction. Similarly in the present embodiment, as shown in FIG. 1C, winding shaft O of air-core coil 41 passes through the center of the core, and a distance h1 from the first principal surface 2*a* of the core to an end of air-core coil 41 and a distance h2 from the second principal surface 2*b* of core to an end of air-core coil 41 are the same. Thus, in the present embodiment, "h" can be shown by the following formula.

$$h=h1=h2=\tfrac{1}{2}\times(HC-HW)$$

In addition, from air-core coil 41, at least a pair of lead 42, which is both ends of wire 4*a*, is led outside of core 2. Led-out wire 4*a*, lead 42, is electrically connected to a pair of terminal part provided on an outer circumferential surface of core 2. Note, a terminal part is not particularly limited, and a well-known configuration can be applied.

When voltage is applied to the terminal part, as described below in detail, the coil device exhibits a predetermined magnetic characteristic when the electrical current flows in the wire constituting the air-core coil and the magnetic flux generates inside core 2.

Figure 3A:
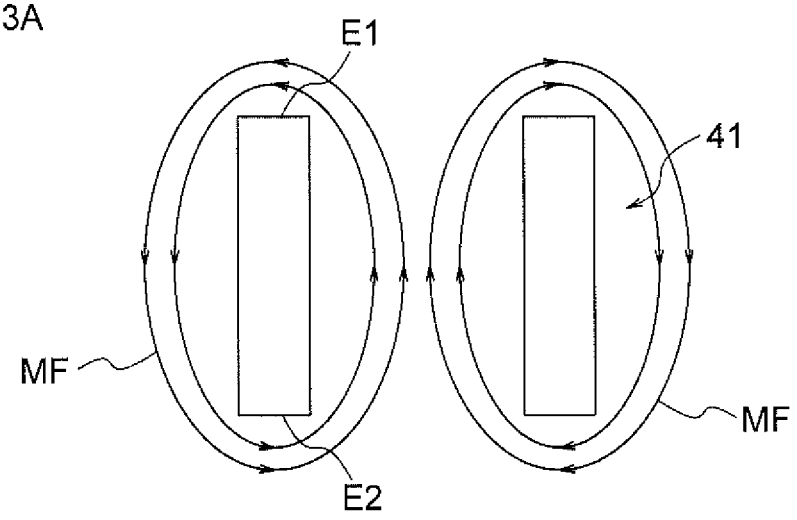
FIG. 3A is a cross sectional view showing the magnetic flux near the air-core coil.
Figure 3B:
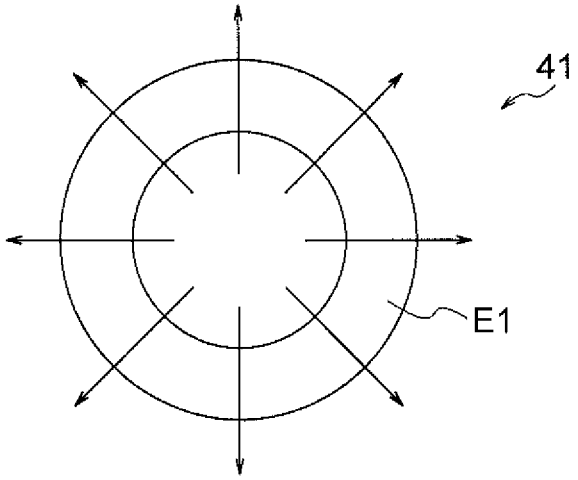
FIG. 3B is a plane view showing the magnetic flux near one end of the air-core coil.
Figure 3C:
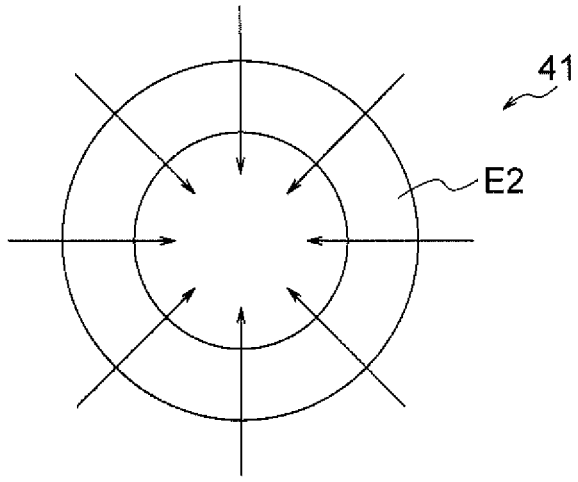
FIG. 3C is a plane view showing the magnetic flux near the other end of the air-core coil+, in the coil device of the first embodiment of the invention.

When the electrical current flows in wire 4*a* constituting the air-core coil, the generated magnetic flux combines, and the magnetic flux processing to a predetermined direction generates. At the time, as shown in FIG. 3A, the magnetic flux MF generates in a direction of penetrating inside the air-core coil 41, which is a hollow part. At one end E1 of air-core coil 41, the magnetic flux MF is bent toward a direction processing outside of air-core coil 41 and is radially expanded corresponding to the outer shape of air-core coil 41, as shown in FIG. 3B. And as shown in FIG. 3A, the magnetic flux MF processes along the outer periphery of air-core coil 41 from one end E1 to the other end E2 of air-core coil 41. At the other end E2 of air-core coil 41, as shown in FIG. 3C, the magnetic flux MF is bent toward a direction processing inside of air-core coil 41, and processes toward inside of air-core coil 41 from every direction of the outer periphery of air-core coil 41.

The magnetic flux density shows the density of the magnetic flux per unit area perpendicular to the magnetic field direction. The magnetic permeability of the magnetic body constituting core 2 is almost the same at the core, and that the magnetic flux density at each place of the core is effected by an area of a place in which the magnetic flux passes through. Therefore, in order to bring the distribution of the magnetic flux density close to uniform, the values of an area in which the magnetic flux passes through in each place of the core can be made close. In other words, variation of an area perpendicular to the magnetic field direction at each place of the core can be reduced.

Here, as obvious from FIGS. 1 and 3, a shape of the place where the magnetic flux passes through changes moment by moment in the core. Thus, according to the present embodiment, a place, where a shape of an area the magnetic flux passes through greatly changes, is specified, and variations of said place is suppressed. In concrete, variations of the cross sectional area of five places, $SA_1$ to $SA_5$, mentioned hereinafter are suppressed.

Figure 4A:
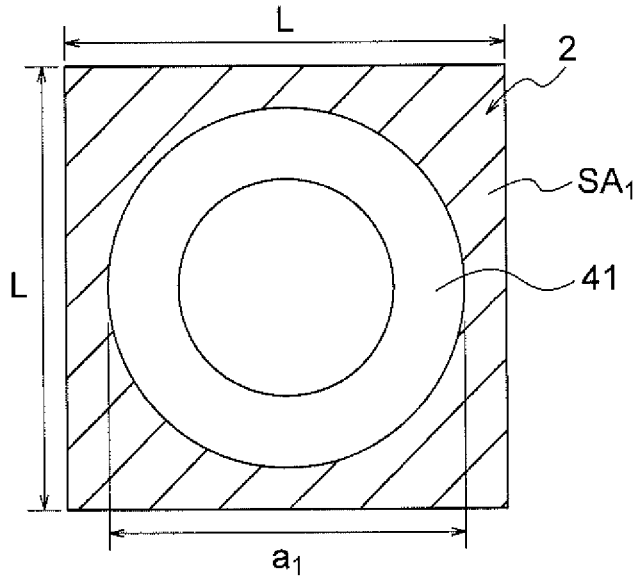
FIG. 4A is a perspective plane view describing the cross section $SA_1$.
Figure 4B:
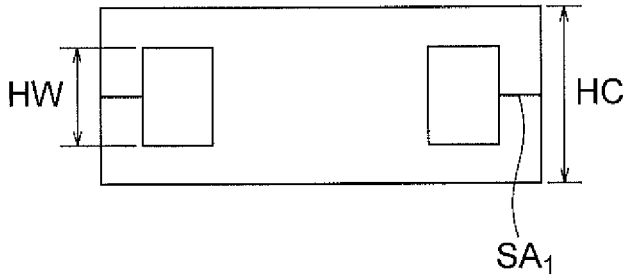
FIG. 4B is a perspective front view describing the cross section $SA_1$, in the coil device of the first embodiment of the invention.

$SA_1$ is a cross sectional area of the core placed at the outer periphery of the air-core coil, in which the magnetic flux passes through from one end to the other end of the air-core coil. $SA_1$ is the shaded area of FIG. 4A. $SA_1$ is an area in which the area of a circle, shown by outer diameter at of air-core coil 41 at ½×HC in a height direction of the core, is subtracted from the area shown by the outer periphery of core 2 at the same place. In the present embodiment, $SA_1$ is shown by the following formula.

$$SA_1 = L^2 - \frac{\pi a_1^2}{4} \quad \text{[Mathematical 3]}$$

When the magnetic flux going around the core part, located at the bottom of the end of air-core coil 41, from the core part, located at the outer periphery of the air-core coil, progresses toward inside the air-core coil, the magnetic flux is radially expanded. And thus, cross sectional area perpendicular to the passed magnetic flux gradually changes. Therefore, considering the gradually changing cross sectional area, an intermediate value thereof is determined $SA_2$. In the present embodiment, $SA_2$ is shown by the following formula.

Figure 5A:
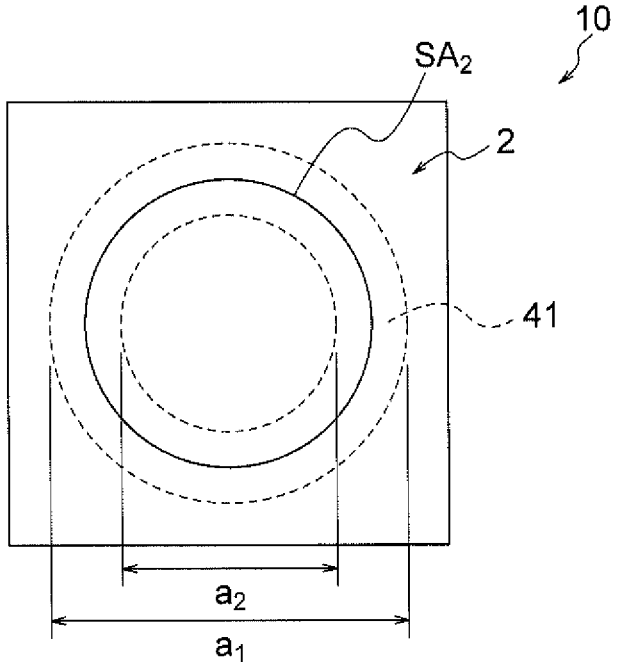
FIG. 5A is a perspective plane view describing the cross section $SA_2$.
Figure 5B:
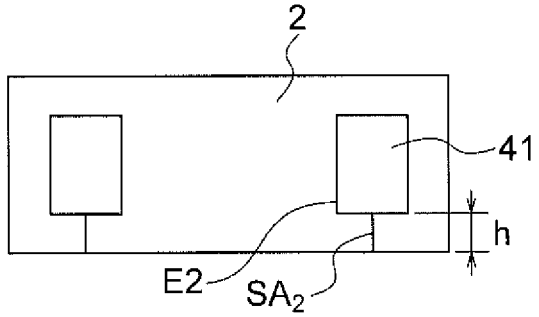
FIG. 5B is a perspective front view describing the cross section $SA_2$.
Figure 5C:
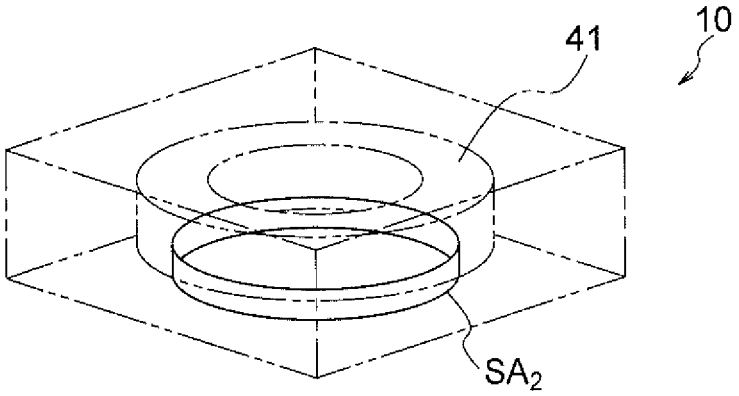
FIG. 5C is a perspective view describing the cross section $SA_2$, in the coil device of the first embodiment of the invention.

Note, as described above, it is difficult to accurately indicate $SA_2$ in the figure because the gradually changing cross sectional area is taken into consideration. It however is exemplified by FIGS. 5A to 5C. $SA_2$ exists between the outer periphery of the air-core coil and the inner periphery of the same. In FIGS. 5A to 5C, $SA_2$ exists near the middle point of the outer periphery of the air-core coil and the inner periphery of the same. $SA_2$ is an area of a cylindrical side surface, having a height of distance "h" between the second principal surface of the core and the end E2 of the air-core coil.

$$SA_2 = \frac{\pi a_1 a_2 h}{(a_1 - a_2)} \ln \frac{a_1}{a_2} \quad \text{[Mathematical 4]}$$

Figure 6A:
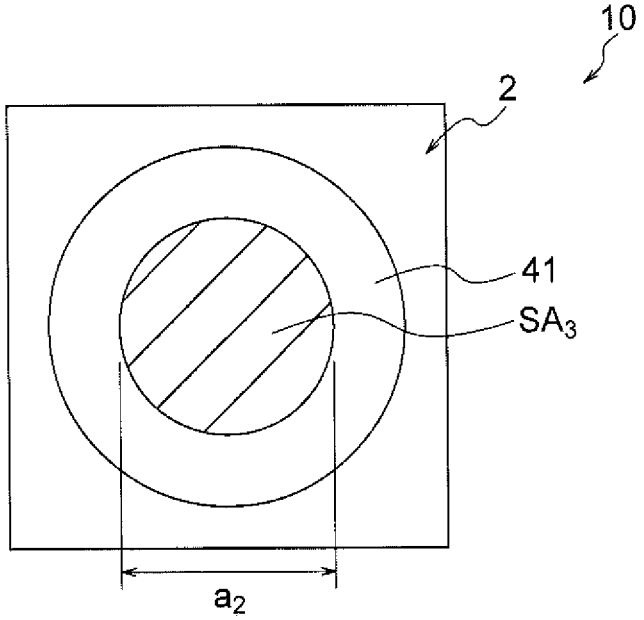
FIG. 6A is a perspective plane view describing the cross section $SA_3$.
Figure 6B:
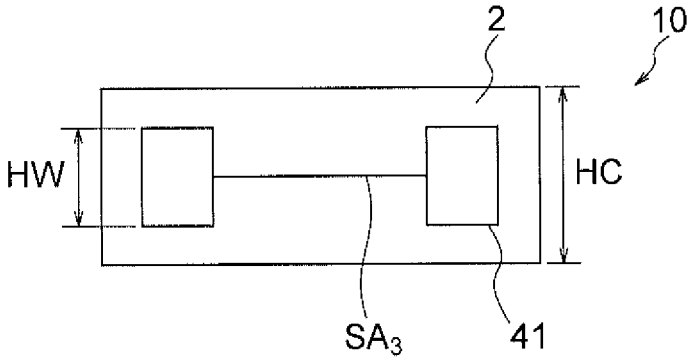
FIG. 6B is a perspective front view describing the cross section $SA_3$, in the coil device of the first embodiment of the invention.

$SA_3$ is a cross sectional area of the core existing inside, a hollow part, of air-core coil 41, in which the magnetic flux passes through. $SA_3$ is the shaded area of FIG. 6A. $SA_3$ is the area of the circle, shown by inner diameter $a_2$ of the air-core coil at ½×HC in a height direction of the core. In the present embodiment, $SA_3$ is shown by the following formula.

$$SA_3 = \frac{\pi a_2^2}{4} \quad \text{[Mathematical 5]}$$

Figure 7A:
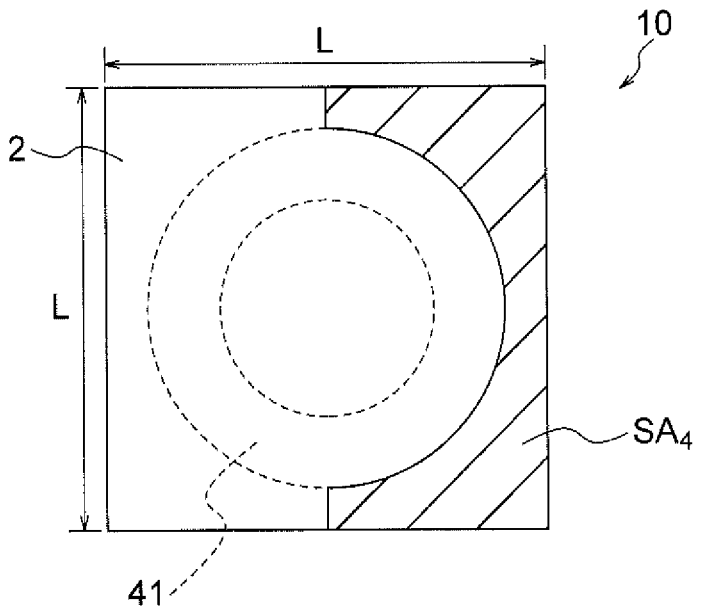
FIG. 7A is a perspective plane view describing the cross section $SA_4$.
Figure 7B:
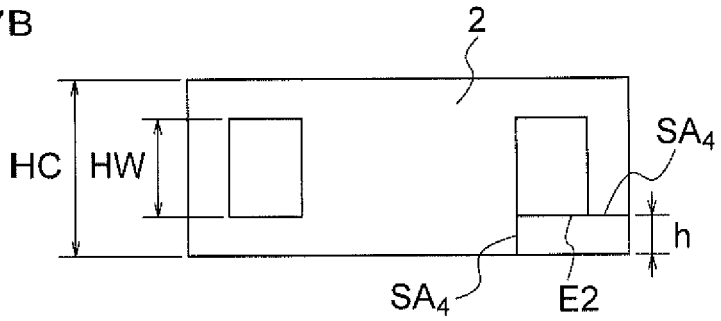
FIG. 7B is a perspective front view describing the cross section $SA_4$.
Figure 7C:
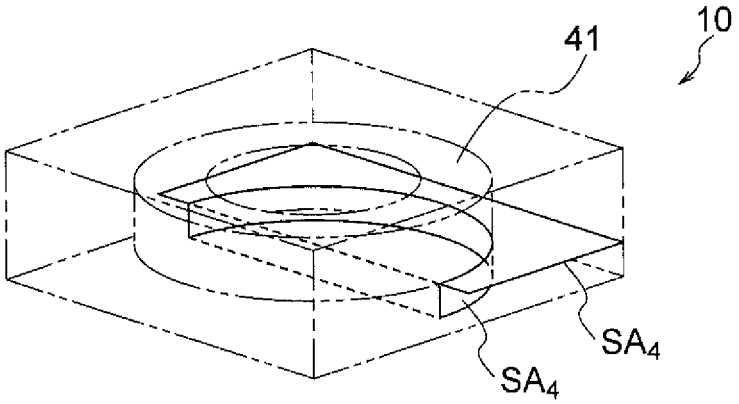
FIG. 7C is a perspective view describing the cross section $SA_4$, in the coil device of the first embodiment of the invention.

$SA_4$ is a cross sectional area in which the magnetic flux passes through from the outer periphery of the air-core coil to the other end of the air-core coil, which is shown by FIGS. 7A to 7C. $SA_4$ is the sum of the following two areas: ½ of an area, in which an area, shown by the outer periphery of the core at end part E2 of the air-core coil in a height direction of said air-core coil, is subtracted by an area of a circle shown by the outer diameter $a_1$ of air-core coil 41 at the same place; and ½ of an area of the cylindrical side surface, having a height of distance "h" between the second principal surface of the core and end E2 of the air-core coil, and passing through the outer diameter of the air-core coil. In the present embodiment, $SA_4$ is shown by the following formula.

$$SA_4 = \frac{1}{2}L^2 - \frac{\pi a_1^2}{8} + \frac{\pi a_1 h}{2} = \frac{1}{2}SA_1 + \frac{\pi a_1 h}{2} \quad \text{[Mathematical 6]}$$

Note, in the present embodiment, the area, in which the area, shown by the outer periphery of the core at end part E2 of the air-core coil in a height direction of said air-core coil, is subtracted by the area of the circle shown by the outer diameter $a_1$ of air-core coil 41 at the same place and the area, in which the area of a circle, shown by outer diameter $a_1$ of air-core coil 41 at ½×HC in a height direction of the core, is subtracted from the area shown by the outer periphery of core 2 at the same place are the same. Thus, $SA_4$ can be shown using $SA_1$.

Figure 8A:
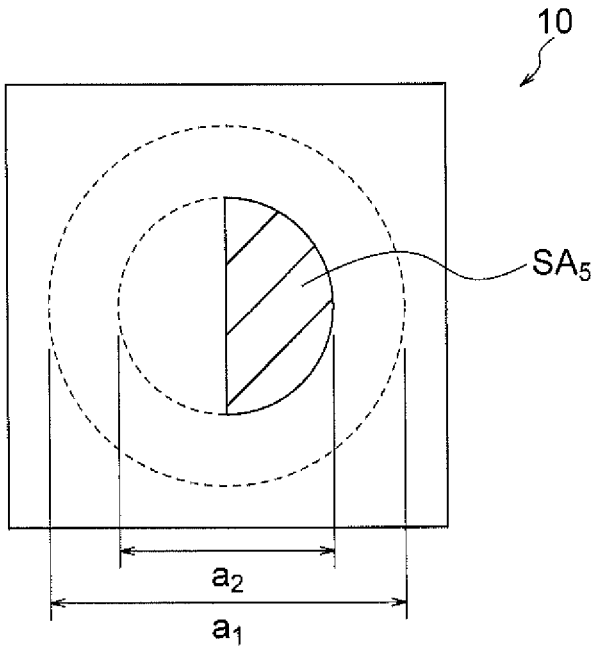
FIG. 8A is a perspective plane view describing the cross section $SA_5$.
Figure 8B:
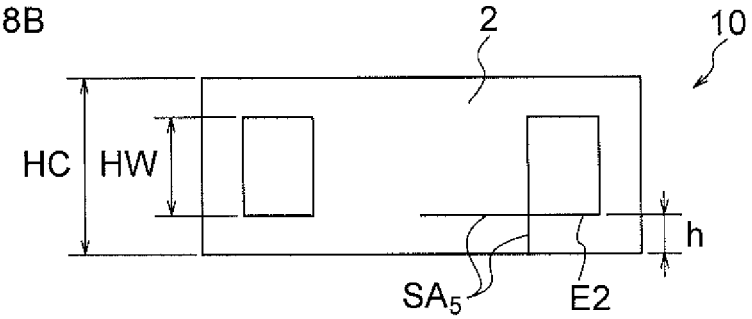
FIG. 8B is a perspective front view describing the cross section $SA_5$.
Figure 8C:
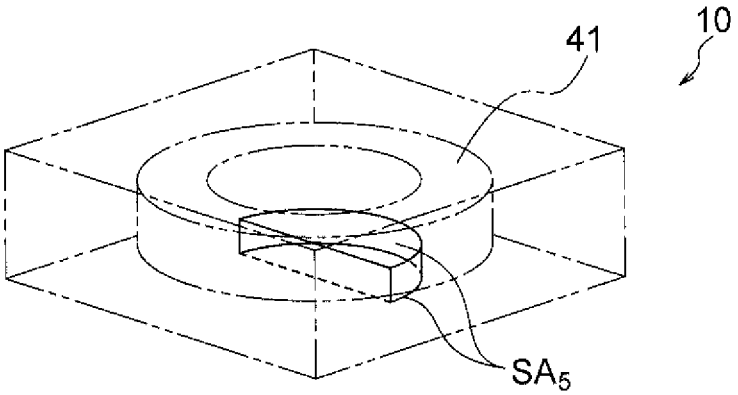
FIG. 8C is a perspective view describing the cross section $SA_5$, in the coil device of the first embodiment of the invention.

$SA_5$ is a cross sectional area of the core, in which the magnetic flux passes through, when said magnetic flux proceeds from the other end of the air-core coil to inside of said air-core coil, which is shown by FIGS. 8A to 8C. $SA_5$ is a sum of the following two areas: ½ of an area of the cylindrical side surface, having a height of the distance "h" between the second principal surface of the core and end E2 of the air-core coil, and passing through the inner diameter of the air-core coil; and ½ of an area of a circle shown by the inner diameter of the air-core coil at end part E2 of the air-core coil in a height direction. In the present embodiment, $SA_5$ is shown by the following formula.

$$SA_5 = \frac{\pi a_2^2}{8} + \frac{\pi a_2 h}{2} = \frac{1}{2}SA_3 + \frac{\pi a_2 h}{2} \quad \text{[Mathematical 7]}$$

Note, in the present embodiment, the area of the circle shown by the inner diameter $a_2$ of the air-core coil at the end E2 of the air-core coil in a height direction and the area of the circle shown by the inner diameter $a_2$ of the air-core coil at ½×HC in a height direction of the core are the same. Thus, $SA_5$ can be shown using $SA_3$.

In the present embodiment, CV values, variational coefficients, of $SA_1$ to $SA_5$ determined above are calculated. The calculated CV values are 0.55 or less, and preferably 0.35 or less. CV value (σ/Δv) can be calculated by obtaining the standard deviation a and the mean value of five values of $SA_1$ to $SA_5$, as shown by the following formula, and then dividing the standard deviation a by the mean value Av.

$$\text{Mean Value: } AV = \frac{SA_1 + SA_2 + SA_3 + SA_4 + SA_5}{5} \quad \text{[Mathematical 8]}$$

$$\text{Standard Deviation: } \sigma = \sqrt{\frac{(SA_1 - Av)^2 + (SA_2 - Av)^2 + (SA_3 - Av)^2 + (SA_4 - Av)^2 + (SA_5 - Av)^2}{5}} \quad \text{[Mathematical 9]}$$

$$CV \text{ Value} = \frac{\text{Standard Deviation: } \sigma}{\text{Mean Value: } Av} \quad \text{[Mathematical 10]}$$

In case when said CV values are within the above range, variation in the area where the magnetic flux passes through is small, and said area does not greatly change. Therefore, a distribution of the magnetic flux density at each place of the core becomes close to uniform, and the magnetic saturation can be suppressed. As a result, the coil device superior in DC superposition characteristic can be obtained.

In case of designing the coil device, due to the problem of mounting, making CV values of $SA_1$ to $SA_5$ within the above range sometimes become difficult. In such cases, among $SA_1$ to $SA_5$, $SA_2$ can be made small to some extent, with respect to the other four cross sections, $SA_1$, $SA_3$, $SA_4$ and $SA_5$.

Namely, it is determined good when "R", showing the ratio of $SA_2$ with respect to the mean value of $SA_1$, $SA_2$, $SA_3$, $SA_4$ and $SA_5$, is smaller than one. "R" can be shown by the following formula.

$$R = \frac{5SA_2}{(SA_1 + SA_2 + SA_3 + SA_4 + SA_5)} \quad \text{[Mathematical 11]}$$

In the present embodiment, "R" is preferably 0.52 or more and 0.95 or less, and more preferably 0.63 or more and 0.95 or less. By determining "R" as mentioned above, and making its value within the above range, $SA_2$ can be made smaller than the other $SA_1$, $SA_3$, $SA_4$ and $SA_5$. Thus, the freedom considering the design of the coil device can be enhanced and a good DC superposition characteristic can be realized.

Coil device according to an embodiment of the invention are preferable for the coil device in which a high frequency and a large current are demanded. Said coil device is, for instance, a power circuit such as a DC-DC converter loaded on a personal computer, a portable electronic device, etc., and a choke coil of a power supply line loaded on a personal computer, a portable electronic device, etc.

1.2 the Second Embodiment

Figure 9A:
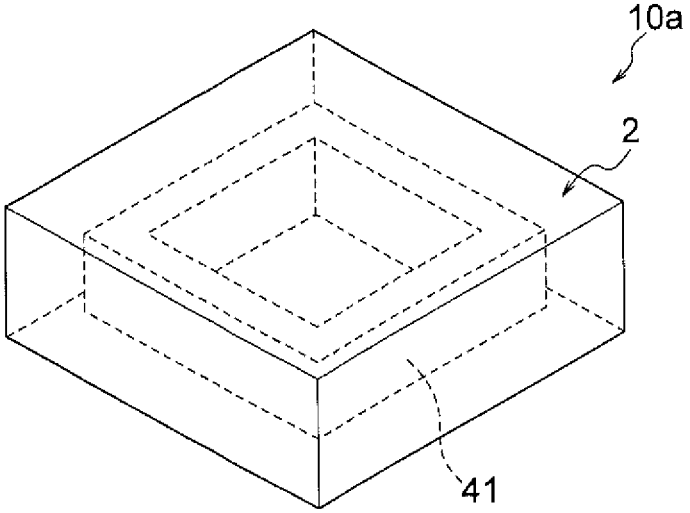
FIG. 9A is a perspective view of the coil device according to the second embodiment of the invention.
Figure 9B:
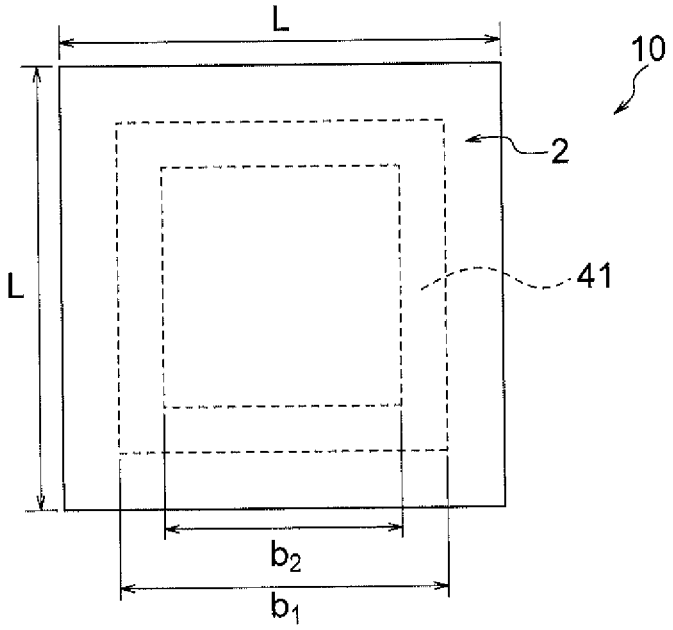
FIG. 9B is a perspective plane view of the coil device according to the second embodiment of the invention.

As shown in FIGS. 9A and 9B, coil device 10*a* according to the second embodiment is similar to coil device 10 of the first embodiment, except air-core coil 41 has a square cylindrical shape having the hollow part. And thus, the overlapped explanation is omitted.

Coil device 10*a* of the second embodiment is capable of exhibiting the same effect as coil device 10 of the first embodiment, when the above described CV values of the cross sections $SA_1$ to $SA_5$ are within the above range. $SA_1$ to $SA_5$ of coil device 10*a* according to the second embodiment can be shown as below using the sizes described in in FIGS. 9A and 9B.

$$SA_1 = L^2 - b_1^2 \quad \text{[Mathematical 12]}$$

$$SA_2 = \frac{4b_1b_2h}{(b_1 - b_2)}\ln\frac{b_1}{b_2} \quad \text{[Mathematical 13]}$$

$$SA_3 = b_2^2 \quad \text{[Mathematical 14]}$$

$$SA_4 = \frac{1}{2}(L^2 - b_1^2) + 2b_1h = \frac{1}{2}SA_1 + 2b_1h \quad \text{[Mathematical 15]}$$

$$SA_5 = \frac{1}{2}b_2^2 + 2b_2h = \frac{1}{2}SA_3 + 2b_2h \quad \text{[Mathematical 16]}$$

Figure 9C:
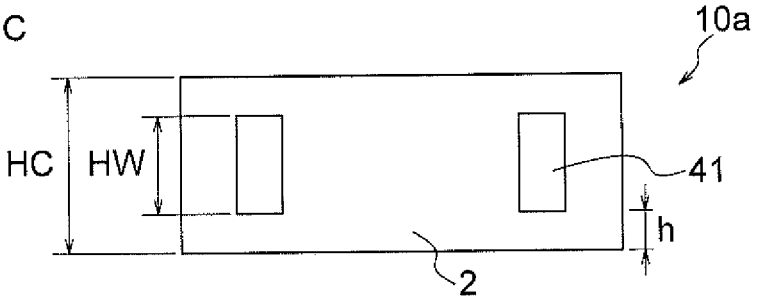
FIG. 9C is a perspective front view of the coil device according to the second embodiment of the invention.

Corner parts of the air-core coil as shown in FIG. 9 may have a chamfered shape, R chamfering, C chamfering, etc, when required.

2. Effects of the Embodiments

According to the above described embodiment, places where the magnetic flux passes through at each part of the core is specified, and variations of areas of said places are suppressed. Namely, CV values of the areas of the specified places are controlled within the above range, in order to make the cross sectional areas perpendicular to the magnetic flux close to uniform. Thus, the distribution of the magnetic flux density becomes close to uniform, the magnetic saturation is effectively suppressed, and the DC superposition characteristic becomes good.

In order to make the CV value small and set said value within the above range, it is desirable to make the values of areas $SA_1$ to $SA_5$ in the present embodiment, where said CV value is calculated, are neared. However, due to the suppression of mounting the coil device, it is sometimes difficult to design the values of $SA_1$ to $SA_5$ to be close to equal, without the generation of the variation.

In such cases, $SA_2$ can be made small relative to the other four cross sectional areas, $SA_1$, $SA_3$, $SA_4$ and $SA_5$. In concrete, by making the values of $SA_2$ with respect to the mean value of $SA_1$, $SA_2$, $SA_3$, $SA_4$ and $SA_5$ within the above range, the freedom considering the design can be secured and the CV value can be made within the above-described range, and thus, a good DC superposition characteristic can be realized.

Hereinbefore, embodiments of the invention are described, but the invention is not limited thereto. The invention can be varied in various modes within a range of the invention.

3. Modified Example

In the present embodiment, the air-core coil is configured by winding the wire for a plural time, however, it is not particularly limited as long as it is configured to have a hollow part. For instance, it may be configured by a ring shape conductor of a roll.

EXAMPLES

Example 1

Hereinafter, the invention will be described referring to the examples, however, the invention is not limited thereto.

A metal magnetic material powder having iron of the magnetic powder as a main component and an epoxy resin as a resin were mixed, and granulated thereof. Subsequently, the air-core coil of a hollow cylindrical foam, manufactured using an insulating coated copper wire, and a granule, obtained by the granulation, were fed into a mold, pressure molded thereof by a predetermined pressure, and an air-core coil buried mold was obtained. Heat treatment was performed to the samples at a predetermined temperature, and the coil device was obtained. Note, the size of the coil device manufactured in Ex. 1 was a square shape having a side of 3 mm, and a height of 1 mm.

In Ex. 1, the coil devices showing different CV value was manufactured by varying the diameter of the outer periphery of the air-core coil, the diameter of the inner periphery of the same, and the height of the air-core coil. Note, area of the cross sectional area perpendicular to the winding axis of the air-core coil and the number of the winding of the winding wire were stable and did not vary.

An initial inductance value and a saturation characteristic of an inductance value when DC superimposed were evaluated to the samples of the obtained coil device. LCR meter, 4284A made by Agilent Technology, was used for the measurement of the inductance value, and DC electrical current was applied using DC bias power source, 42841A made by Agilent Technology.

The initial inductance value is an inductance value, in which DC electrical current is not applied. The saturation characteristic of the inductance value when DC superimposed was evaluated by the impressed DC value (Idc1), which is declined by 20% from the initial inductance value when DC superimposed.

The larger the initial inductance value is, the superior the property of the coil device is. As Idc1 is larger, a high inductance value can be maintained till a range of large current, and the DC superposition characteristics, an index indicating the magnetic saturation characteristic, is superior. Results are shown in Table 1.

TABLE 1

| | CV values of $SA_1$ to $SA_5$ | R | Initial Inductance [μH] | DC superimposing characteristic Idc1 [A] |
|---|---|---|---|---|
| Ex. 1 | 0.05 | 0.95 | 8.08 | 3.29 |
| Ex. 2 | 0.10 | 0.88 | 8.07 | 3.27 |
| Ex. 3 | 0.15 | 0.82 | 8.02 | 3.23 |
| Ex. 4 | 0.23 | 0.76 | 7.90 | 3.18 |
| Ex. 5 | 0.29 | 0.68 | 7.78 | 3.14 |
| Ex. 6 | 0.35 | 0.63 | 7.61 | 3.10 |
| Ex. 7 | 0.39 | 0.60 | 7.34 | 3.05 |
| Ex. 8 | 0.48 | 0.56 | 7.03 | 3.00 |
| Ex. 9 | 0.55 | 0.52 | 6.67 | 2.95 |
| Comp. Ex. 1 | 0.58 | 0.50 | 6.38 | 2.90 |
| Comp. Ex. 2 | 0.67 | 0.47 | 5.88 | 2.84 |
| Comp. Ex. 3 | 0.80 | 0.43 | 5.02 | 2.74 |

The CV values of Ex. 1 to 9 were all within the above range, and that the initial inductance value and the saturation characteristic of the inductance value when DC superimposed according to Ex. 1 to 9 were all good relative to the same of Comp. Ex. 1 to 3.

In addition, even $SA_2$ is set small, as long as "R" is within the above range, it was confirmed that both the initial inductance value and the saturation characteristic of the inductance when DC superimposed according to Ex. 1 to 9 were confirmed to be good relative to the same of Comp. Ex. 1 to 3.

Example 2

The coil device was manufactured similarly to the same of Ex. 1, except the shape of the air-core coil is made to be a hollow square cylindrical shape, and the same evaluation as in Ex. 1 was performed. Results are shown in Table 2.

TABLE 2

| | CV values of $SA_1$ to $SA_5$ | R | Initial Inductance [μH] | DC superimposing characteristic Idc1 [A] |
|---|---|---|---|---|
| Ex. 10 | 0.04 | 0.95 | 8.17 | 3.32 |
| Ex. 11 | 0.23 | 0.78 | 7.98 | 3.22 |
| Ex. 12 | 0.35 | 0.63 | 7.71 | 3.14 |
| Ex. 13 | 0.48 | 0.57 | 7.09 | 3.03 |
| Ex. 14 | 0.55 | 0.52 | 6.74 | 2.97 |
| Comp. Ex. 4 | 0.59 | 0.50 | 6.44 | 2.93 |
| Comp. Ex. 5 | 0.73 | 0.45 | 5.53 | 2.83 |

From Table 2, it was confirmed that DC superposition characteristic is good even when the CV value is within the above range, even when the air-core coil has the hollow square cylindrical shape. In addition, it was confirmed that the DC superposition characteristic is good by making "R" within the above range, even when $SA_2$ is set small.

NUMERICAL REFERENCES

10, 10*a* . . . Coil device
2 . . . Core
4*a* . . . Wire
41 . . . Air-core coil
42 . . . Lead

The invention claimed is:

1. A coil device comprising:
a core comprising a magnetic powder and a resin;
an air-core coil of a cylindrical shape; and
a lead, led from the air-core coil, wherein
at least the entire air-core coil is buried inside the core,
a CV value of below described cross sectional areas, $SA_1$ to $SA_5$, is 0.55 or less, when an outer diameter of the air-core coil is "$a_1$", an inner diameter of the air-core coil is "$a_2$", and a distance between a surface of the core perpendicular to a direction of winding axis of the air-core coil and an end of the air-core coil in the direction of winding axis of the air-core coil is "h", in the coil device,
$SA_1$ is an area, wherein an area formed by an outer periphery of the core is subtracted by an area formed by an outer periphery of the air-core coil, on a cross section perpendicular to the direction of winding axis of the air-core coil, at ½ of a length of the core in the direction of winding axis of the air-core coil,
$SA_2$ is an area expressed by the following formula, $$SA_2 = \frac{\pi a_1 a_2 h}{(a_1 - a_2)} \ln \frac{a_1}{a_2} \quad \text{[Mathematical 1]}$$

$SA_3$ is an area formed by an inner periphery of the air-core coil, on the cross section perpendicular to the direction of winding axis of the air-core coil, at ½ of the length of the core in the direction of winding axis of the air-core coil,
$SA_4$ is a sum of ½ of the area, wherein the area formed by the outer periphery of the core is subtracted by the area formed by the outer periphery of the air-core coil, and an area shown by $\pi a_1 h \times ½$, on the cross section perpendicular to the direction of winding axis of the air-core coil, at the end of the air-core coil in the direction of winding axis of the air-core coil, and
$SA_5$ is a sum of ½ of the area formed by the inner periphery of the air-core coil, and an area shown by $\pi a_2 h \times ½$, on the cross section perpendicular to the direction of winding axis of the air-core coil, at the end of the air-core coil in the direction of winding axis of the air-core coil.

2. A coil device comprising:
a core comprising a magnetic powder and a resin;
an air-core coil of a square cylindrical shape; and
a lead, led from the air-core coil, wherein
at least the entire air-core coil is buried inside the core,
a CV value of below described cross sectional areas, $SA_1$ to $SA_5$, is 0.55 or less, when a length of one side forming an outer periphery of the air-core coil is "$b_1$", a length of one side forming an inner periphery of the air-core coil is "$b_2$" and a distance between a surface of the core perpendicular to a direction of winding axis of the air-core coil and an end of the air-core coil in the direction of winding axis of the air-core coil is "h", in the coil device,
$SA_1$ is an area, wherein an area formed by an outer periphery of the core is subtracted by an area formed by an outer periphery of the air-core coil, on a cross section perpendicular to the direction of winding axis of the air-core coil at ½ of a length of the core in the direction of winding axis of the air-core coil,
$SA_2$ is an area expressed by the following formula, $$SA_2 = \frac{4 b_1 b_2 h}{(b_1 - b_2)} \ln \frac{b_1}{b_2} \quad \text{[Mathematical 2]}$$

$SA_3$ is an area formed by an inner periphery of the air-core coil, on the cross section perpendicular to the direction of winding axis of the air-core coil, at ½ of a length of the core in the direction of winding axis of the air-core coil,
$SA_4$ is a sum of ½ of the area, wherein the area formed by the outer periphery of the core is subtracted by the area formed by the outer periphery of the air-core coil, and an area shown by $2b_1h$, on the cross section perpendicular to the direction of winding axis of the air-core coil, at the end of the air-core coil in the direction of winding axis of the air-core coil, and
$SA_5$ is a sum of ½ of the area formed by the inner periphery of the air-core coil, and an area shown by $2b_2h$, on the cross section perpendicular to the direction of winding axis of the air-core coil, at the end of the air-core coil in the direction of winding axis of the air-core coil.

3. The coil device according to claim 1, wherein the CV value is 0.35 or less.

4. The coil device according to claim 2, wherein the CV value is 0.35 or less.

5. The coil device according to claim 1, wherein the below described "R" is 0.52 or more and 0.95 or less, $$R{:}5\times(SA_2)/(SA_1+SA_2+SA_3+SA_4+SA_5).$$

6. The coil device according to claim 2, wherein the below described "R" is 0.52 or more and 0.95 or less, $$R{:}5\times(SA_2)/(SA_1+SA_2+SA_3+SA_4+SA_5).$$

7. The coil device according to claim 5, wherein said "R" is 0.63 or more and 0.95 or less.

8. The coil device according to claim 6, wherein said "R" is 0.63 or more and 0.95 or less.

* * * * *